US011079706B2

(12) United States Patent
Kobayashi

(10) Patent No.: US 11,079,706 B2
(45) Date of Patent: Aug. 3, 2021

(54) FIXING DEVICE AND IMAGE FORMING APPARATUS

(71) Applicant: FUJIFILM Business Innovation Corp., Tokyo (JP)

(72) Inventor: Jouta Kobayashi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/858,682

(22) Filed: Apr. 26, 2020

(65) Prior Publication Data

US 2021/0116849 A1 Apr. 22, 2021

(30) Foreign Application Priority Data

Oct. 16, 2019 (JP) ..... JP2019-189218

(51) Int. Cl.
*G03G 15/20* (2006.01)

(52) U.S. Cl.
CPC . *G03G 15/2064* (2013.01); *G03G 2215/2035* (2013.01)

(58) Field of Classification Search
CPC ..... G03G 15/2064; G03G 2215/2016; G03G 2215/2035; G03G 2215/2038
USPC ..... 399/107, 110, 122, 320, 328, 329
See application file for complete search history.

(56) References Cited

U.S. PATENT DOCUMENTS 10,459,383 B2 * 10/2019 Sato ..... G03G 15/2064
2009/0304421 A1 * 12/2009 Saito ..... G03G 15/2053 399/329

FOREIGN PATENT DOCUMENTS

JP 2014-115509 6/2014
JP 6172925 8/2017

* cited by examiner

*Primary Examiner* — Hoan H Tran
(74) *Attorney, Agent, or Firm* — JCIPRNET

(57) ABSTRACT

A fixing device includes a belt member, a pressing member, a first member, a second member, and a support member. The pressing member forms a passer between the pressing member and the belt member. The passer passes while pressing a recording medium. The first member comes into contact with the belt member on an inner side of the belt member. The first member receives pressing force in a first direction from the pressing member. The second member is disposed on the inner side of the belt member. The second member receives pressing force of the pressing member with the first member interposed therebetween. The support member is interposed between the first member and the second member. The support member supports the first member so that an area over which the support member supports the first member and an area over which the support member is supported by the second member overlap in the first direction.

9 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2019-189218 filed Oct. 16, 2019.

BACKGROUND

(i) Technical Field

The present disclosure relates to a fixing device and an image forming apparatus.

(ii) Related Art

Japanese Patent No. 6172925 describes a heater holder formed from a heat-resistant resin. The heater holder holds a ceramic heater, and is partially in contact with the fixing belt to serve as a guide for a fixing belt while the fixing belt is running.

SUMMARY

The fixing device may also include a belt member and a support member that supports the belt member from the inside. Here, when the support member receives external force, a moment of rotation may be exerted on the support member. When a large moment of rotation is exerted on the support member, the support member is more likely to be deformed.

Aspects of non-limiting embodiments of the present disclosure relate to prevention of deformation of a support member unlike in the case where a large moment of rotation is exerted on the support member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device that includes a belt member, a pressing member, a first member, a second member, and a support member. The pressing member forms a passer between the pressing member and the belt member. The passer passes while pressing a recording medium. The first member comes into contact with the belt member on an inner side of the belt member. The first member receives pressing force in a first direction from the pressing member. The second member is disposed on the inner side of the belt member. The second member receives pressing force of the pressing member with the first member interposed therebetween. The support member is interposed between the first member and the second member. The support member supports the first member so that an area over which the support member supports the first member and an area over which the support member is supported by the second member overlap in the first direction.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below in detail with reference to the attached drawings.

Description of Image Forming Apparatus

Figure 1:
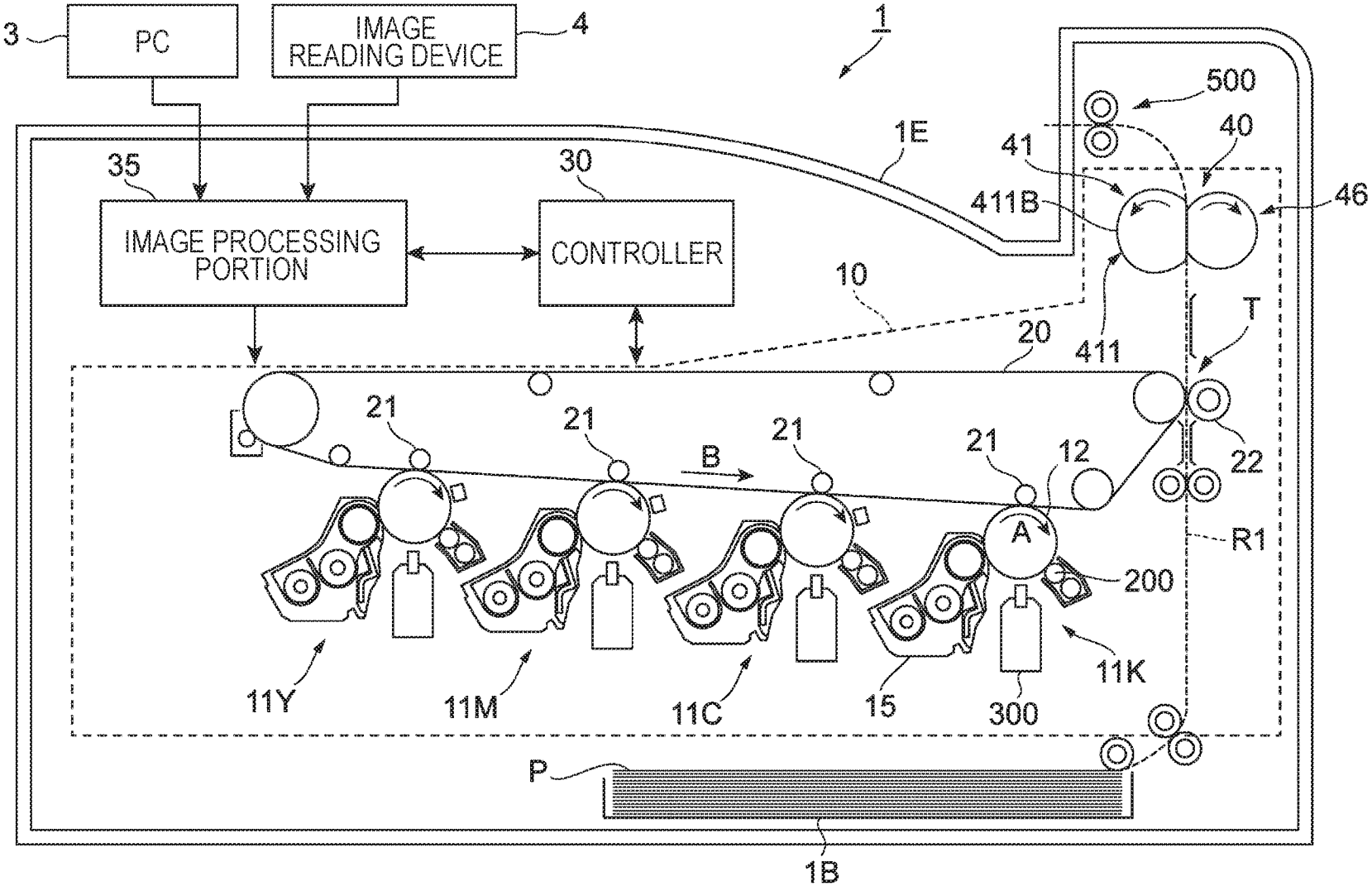
FIG. 1 illustrates an entire structure of an image forming apparatus.

FIG. 1 illustrates an entire structure of an image forming apparatus 1. More specifically, FIG. 1 is a view of the image forming apparatus 1 viewed from the front side of the image forming apparatus 1.

The image forming apparatus 1 is a so-called tandem color printer.

The image forming apparatus 1 includes an image forming portion 10, as an example of an image forming device. The image forming portion 10 performs image formation on a sheet P, which is an example of a recording medium, based on image data for different colors.

The image forming apparatus 1 also includes a controller 30 and an image processing portion 35.

The controller 30 controls functional units of the image forming apparatus 1.

The image processing portion 35 performs image processing on image data from, for example, a personal computer (PC) 3 or an image reading device 4.

The image forming portion 10 includes four image forming units 11Y, 11M, 11C, and 11K (hereinafter also simply referred to as "image forming units 11", collectively) arranged side by side at regular intervals.

The image forming units 11 have the same structure except for accommodating different types of toner in respective developing devices 15. The image forming units 11 form toner images (images) of yellow (Y), magenta (M), cyan (C), and black (K).

Each image forming unit 11 includes a photoconductor drum 12, a charging device 200, which electrically charges the photoconductor drum 12, and a LED print head (LPH) 300, which exposes the photoconductor drum 12 to light.

The photoconductor drum 12 is electrically charged by the charging device 200. The photoconductor drum 12 is also exposed to light by the LPH 300 to have an electrostatic latent image formed thereon.

Each image forming unit 11 also includes a developing device 15, which develops an electrostatic latent image formed on the photoconductor drum 12, and a cleaner (not illustrated) that cleans the surface of the photoconductor drum 12.

The image forming portion 10 includes an intermediate transfer belt 20, to which toner images of different colors formed by the photoconductor drums 12 are transferred, and first transfer rollers 21, which sequentially transfer (first-transfer) the toner images of different colors formed by the photoconductor drums 12 to the intermediate transfer belt 20.

The image forming portion 10 also includes a second transfer roller 22, which collectively transfers (second-transfers) the toner images transferred onto the intermediate transfer belt 20 to a sheet P, and a fixing device 40, which fixes the toner images transferred to the sheet P onto the sheet P.

The fixing device 40 includes a fixing belt module 41 including a heating member, and a pressing roller 46.

The fixing belt module 41 is disposed on the left of a sheet transport path R1 in the drawing. The pressing roller 46 is disposed on the right of the sheet transport path R1 in the drawing. The pressing roller 46 is pressed against the fixing belt module 41.

The fixing belt module 41 includes a film-shaped fixing belt 411, which comes into contact with the sheet P.

The fixing belt 411, which is an example of a belt member, includes, for example, a release layer disposed outermost to come into contact with the sheet P, an elastic layer disposed adjacent to and on the inner side of the release layer, and a base layer that supports the elastic layer.

The fixing belt 411 is endless and circularly moves counterclockwise in the drawing. The fixing belt 411 extends in the axial direction.

The fixing belt 411 is in contact with the sheet P transported from below in the drawing. The portion of the fixing belt 411 that is in contact with the sheet P moves together with the sheet P. The fixing belt 411 holds the sheet P together with the pressing roller 46 to press and heat the sheet P.

The fixing belt module 41 also includes a heating member (described below) on the inner side of the fixing belt 411 to heat the fixing belt 411.

The pressing roller 46 serving as an example of a pressing member is disposed on the right side of the sheet transport path R1 in the drawing. The pressing roller 46 is pressed against the outer peripheral surface 411B of the fixing belt 411 to press the sheet P passing between the fixing belt 411 and the pressing roller 46 (the sheet P moving along the sheet transport path R1).

The pressing roller 46 is rotated clockwise in the drawing by a motor (not illustrated). When the pressing roller 46 rotates clockwise, the fixing belt 411 rotates counterclockwise with the driving force received from the pressing roller 46.

In the image forming apparatus 1, the image processing portion 35 performs image processing on image data from the PC 3 or the image reading device 4, and the image data undergoing image processing is fed to each image forming unit 11.

Then, for example, in the image forming unit 11K for black (K), the photoconductor drum 12 is electrically charged by the charging device 200 while rotating in the direction of arrow A, and exposed to light emitted from the LPH 300 on the basis of the image data transmitted from the image processing portion 35.

Thus, an electrostatic latent image for a black (K) image is formed on the photoconductor drum 12. The electrostatic latent image formed on the photoconductor drum 12 is developed by the developing device 15 into a toner image for black (K) formed on the photoconductor drum 12.

Similarly, the image forming units 11Y, 11M, and 11C respectively form toner images of yellow (Y), magenta (M), and cyan (C).

The toner images of respective colors formed by the respective image forming units 11 are sequentially electrostatically attracted by the first transfer rollers 21 to the intermediate transfer belt 20 moving in the direction of arrow B, so that a superposed toner image including toner of different colors is formed on the intermediate transfer belt 20.

The toner image formed on the intermediate transfer belt 20 is transported to a position (second transfer portion T) where the second transfer roller 22 is located by the movement of the intermediate transfer belt 20. At the timing when the toner image is transported to the second transfer portion T, a sheet P is fed from a sheet container 1B to the second transfer portion T.

At the second transfer portion T, the toner image on the intermediate transfer belt 20 is collectively and electrostatically transferred to the sheet P transported to the second transfer portion T with a transfer electric field formed by the second transfer roller 22.

Thereafter, the sheet P to which the toner image is electrostatically transferred is separated from the intermediate transfer belt 20, and transported to the fixing device 40.

The fixing device 40 holds the sheet P between the fixing belt module 41 and the pressing roller 46. More specifically, the fixing device 40 holds the sheet P with the fixing belt 411, circularly moving counterclockwise, and the pressing roller 46, rotating clockwise.

Thus, the sheet P undergoes pressing and heating to have a toner image thereon fixed thereto. The sheet P undergoing fixing is transported to a sheet receiver 1E by discharging rollers 500.

Structure of Fixing Device

The structure of the fixing device 40 will now be described.

Figure 2:
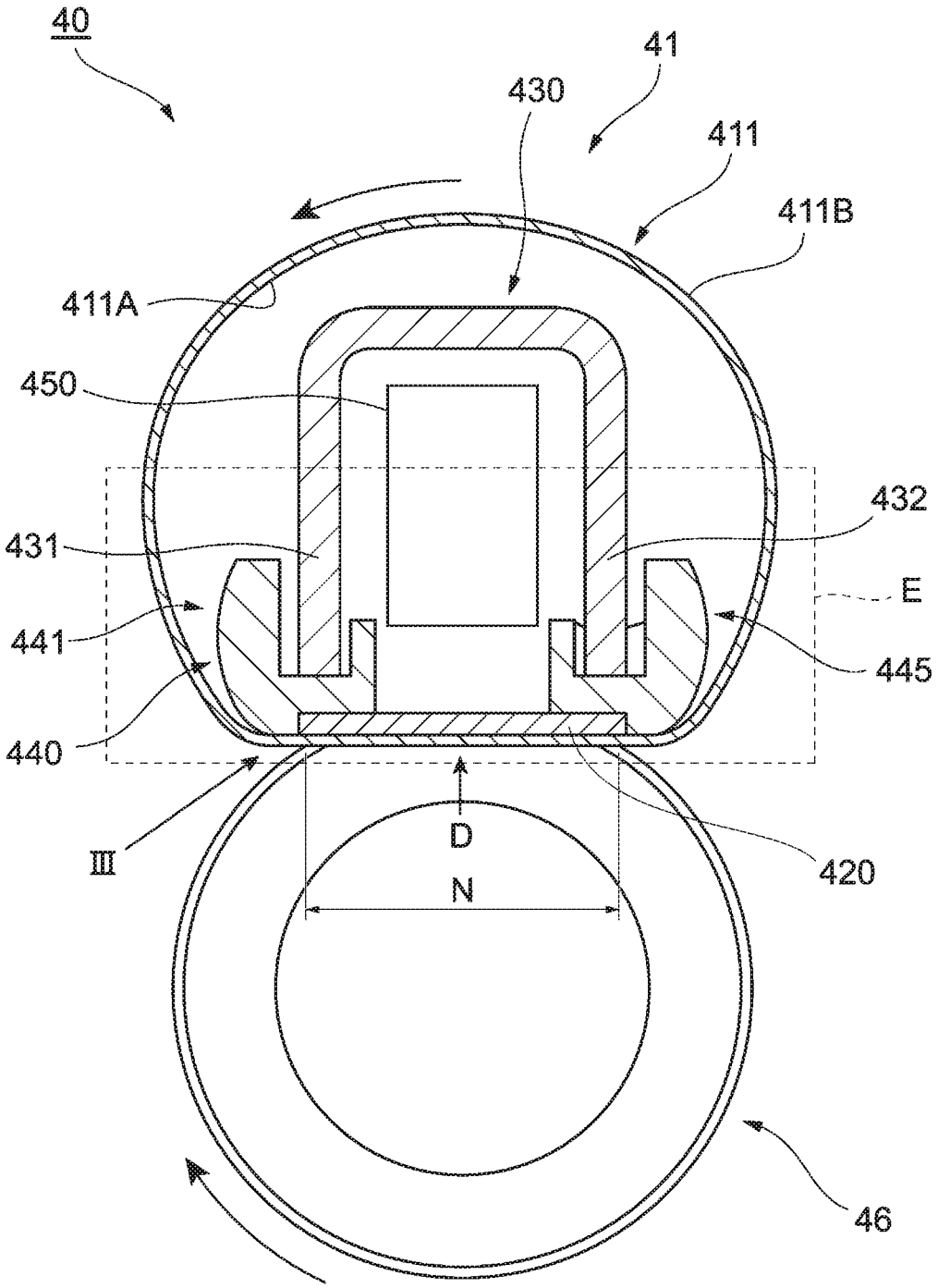
FIG. 2 illustrates a structure of a fixing device.

FIG. 2 illustrates a structure of the fixing device 40.

The fixing belt module 41 includes the fixing belt 411 to fix the toner image onto the sheet P. The fixing belt 411 is pressed against the surface of the sheet P on which the toner image is formed.

The pressing roller 46 is pressed against the outer peripheral surface 411B of the fixing belt 411 to press the sheet P passing between the fixing belt 411 and the pressing roller 46.

Specifically, the pressing roller 46 forms, between itself and the fixing belt 411, a nip portion N, which is an area that comes into contact with the outer peripheral surface 411B of the fixing belt 411 and through which the sheet P passes while being pressed. Here, the nip portion N is regarded as a passer that passes while pressing the sheet P.

In the present exemplary embodiment, in the process where the sheet P passes through the nip portion N, the sheet P is heated and pressed to have a toner image fixed thereto.

A heating member 420, which heats the fixing belt 411, is disposed on the inner side of the fixing belt 411.

The heating member 420, which is an example of a first member, has a plate shape, and extends in the movement direction and the axial direction of the fixing belt 411. More specifically, the heating member 420 is disposed from upstream of the center of the nip portion N to downstream of the center of the nip portion N in the movement direction of the fixing belt 411. The heating member 420 is in contact with the fixing belt 411 to feed heat to the fixing belt 411 to heat the fixing belt 411. A portion of the fixing belt 411 that is in contact with the heating member 420 is flat along the heating member 420. In the present exemplary embodiment, the pressing roller 46 is pressed against the heating member 420 with the fixing belt 411 interposed therebetween. The heating member 420 thus receives pressing force from the pressing roller 46 in the direction of arrow D in the drawing. Also in another structure where the heating member 420 is pressed against the pressing roller 46 with the fixing belt 411 interposed therebetween, the heating member 420 receives pressing force from the pressing roller 46 in the direction of arrow D in the drawing.

The fixing belt module 41A includes a belt support member 440, which supports the fixing belt 411 from the inside. The belt support member 440, which is an example of a support member, is disposed from upstream of the center of the nip portion N to downstream of the center of the nip portion N in the movement direction of the fixing belt 411. The belt support member 440 includes an upstream support portion 441 and a downstream support portion 445.

The upstream support portion 441 is disposed upstream of the center of the nip portion N in the movement direction of the fixing belt 411. The upstream support portion 441 extends in the axial direction of the fixing belt 411. The upstream support portion 441 is in contact with part of an inner peripheral surface 411A of the fixing belt 411 to support the fixing belt 411 from the inside.

The downstream support portion 445 is disposed downstream of the center of the nip portion N in the movement direction of the fixing belt 411. The downstream support portion 445 extends in the axial direction of the fixing belt 411. The downstream support portion 445 is in contact with part of the inner peripheral surface 411A of the fixing belt 411 to support the fixing belt 411 from the inside.

The fixing belt module 41 also includes a support frame 430, which is an example of a second member. The support frame 430 extends in the axial direction of the fixing belt 411. The support frame 430 is disposed on the inner side of the fixing belt 411 to support the belt support member 440. The support frame 430 is supported by a supporting device, not illustrated, disposed outside in the axial direction of the fixing belt 411 to be fixed in position with respect to the fixing belt module 41. The support frame 430 is formed from, for example, a metal material.

The support frame 430 includes an upstream frame 431 and a downstream frame 432.

The upstream frame 431 is disposed upstream of the center of the nip portion N in the movement direction of the fixing belt 411. The upstream frame 431 supports the upstream support portion 441.

The downstream frame 432 is disposed downstream of the center of the nip portion N in the movement direction of the fixing belt 411. The downstream frame 432 supports the downstream support portion 445.

The fixing belt module 41 also includes a sensor 450. The sensor 450 is disposed on the inner side of the support frame 430. The sensor 450 is used by a controller 30 to perform controlling. The sensor 450 is, for example, a temperature sensor that measures the temperature of the fixing belt module 41.

Figure 3:
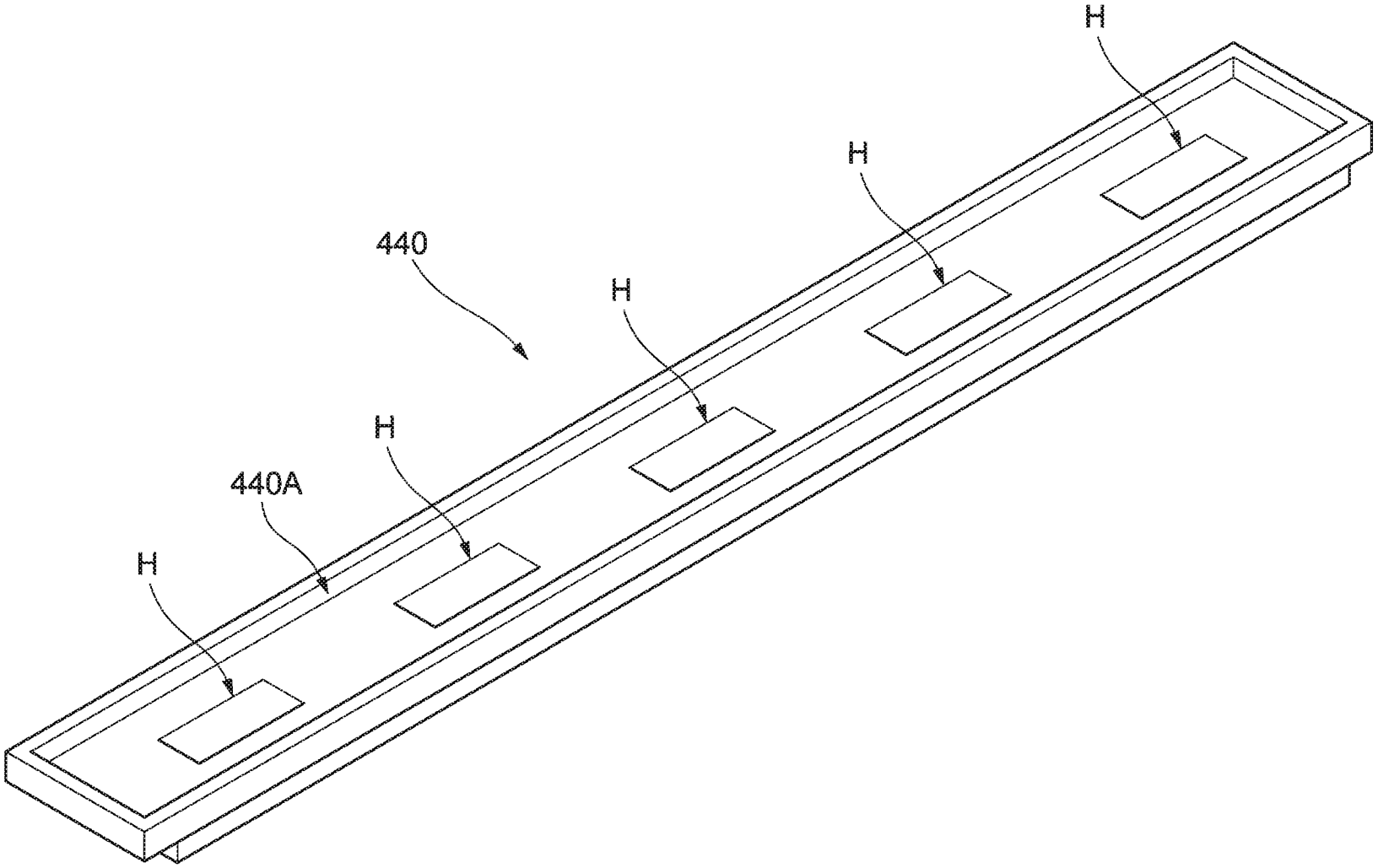
FIG. 3 is a perspective view of a belt support member viewed in a direction of arrow III in FIG. 2.

FIG. 3 is a perspective view of the belt support member 440 viewed in the direction of arrow III in FIG. 2.

The belt support member 440 according to the present exemplary embodiment has a recess 440A. In the present exemplary embodiment, the heating member 420 is fitted into the recess 440A so that the position of the heating member 420 is fixed relative to the belt support member 440.

The recess 440A of the belt support member 440 has multiple openings H. This structure reduces the area of the heating member 420 that comes into contact with the belt support member 440 further than in the case of the structure where the recess 440A of the belt support member 440 has no openings.

Figure 4:
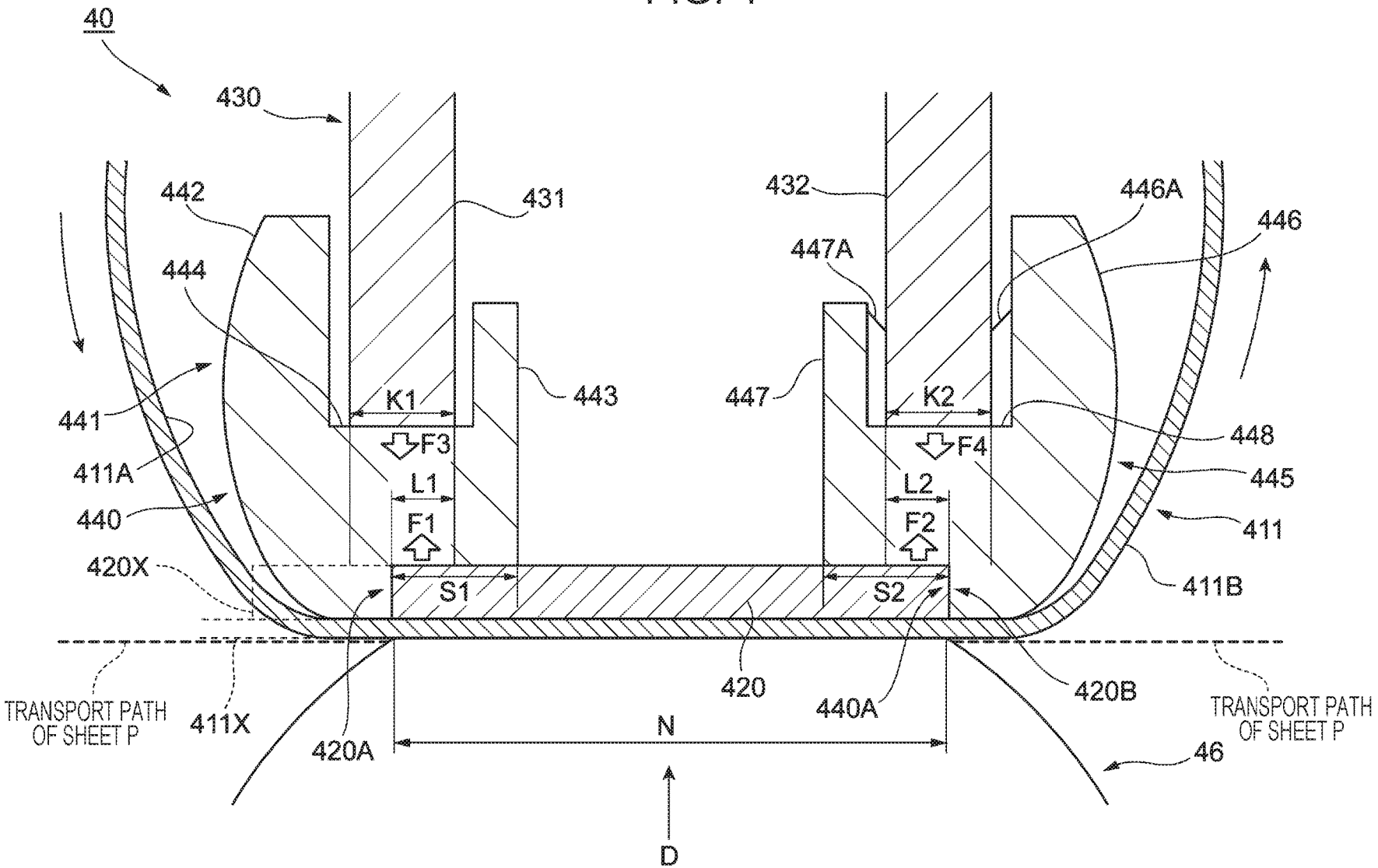
FIG. 4 is an enlarged view of an area E in FIG. 2.

FIG. 4 is an enlarged view of an area E in FIG. 2. FIG. 4 omits illustration of the structure of the sensor 450.

The upstream support portion 441 of the belt support member 440 includes a first protrusion 442, a second protrusion 443, and a connector 444.

The first protrusion 442 is disposed upstream of the second protrusion 443 in the movement direction of the fixing belt 411. The first protrusion 442 protrudes toward the inner peripheral surface 411A of the fixing belt 411. More specifically, the first protrusion 442 protrudes upward in the drawing.

The second protrusion 443 protrudes toward the inner peripheral surface 411A of the fixing belt 411. More specifically, the second protrusion 443 protrudes upward in the drawing.

The first protrusion 442 extends higher than the second protrusion 443 in the drawing. More specifically, the length by which the first protrusion 442 protrudes is larger than the length by which the second protrusion 443 protrudes, and smaller than twice the length by which the second protrusion 443 protrudes.

The connector 444 connects the first protrusion 442 and the second protrusion 443.

The downstream support portion 445 according to the present exemplary embodiment includes a first protrusion 446, a second protrusion 447, and a connector 448.

The first protrusion 446 is disposed downstream of the second protrusion 447 in the movement direction of the fixing belt 411. The first protrusion 446 protrudes toward the inner peripheral surface 411A of the fixing belt 411. More specifically, the first protrusion 446 protrudes upward in the drawing. The first protrusion 446 includes a rib 446A, extending upstream in the movement direction of the fixing belt 411.

The second protrusion 447 protrudes toward the inner peripheral surface 411A of the fixing belt 411. More specifically, the second protrusion 447 protrudes upward in the drawing. The second protrusion 447 includes a rib 447A, extending downstream in the movement direction of the fixing belt 411.

The first protrusion 446 extends higher than the second protrusion 447 in the drawing. More specifically, the length by which the first protrusion 446 protrudes is larger than the length by which the second protrusion 447 protrudes, and smaller than twice the length by which the second protrusion 447 protrudes.

The connector 448 connects the first protrusion 446 and the second protrusion 447.

On the inner side of the fixing belt 411, the upstream frame 431 of the support frame 430 supports the connector 444 of the upstream support portion 441. Here, the upstream frame 431 is located between the first protrusion 442 and the second protrusion 443 of the upstream support portion 441. A space is left between the first protrusion 442 and the upstream frame 431, and a space is left between the second protrusion 443 and the upstream frame 431.

On the inner side of the fixing belt 411, the downstream frame 432 of the support frame 430 supports the connector 448 of the downstream support portion 445. Here, the downstream frame 432 is interposed between the first protrusion 446 and the second protrusion 447 of the downstream support portion 445. More specifically, the downstream frame 432 is interposed between the rib 446A of the first protrusion 446 and the rib 447A of the second protrusion 447.

The upstream support portion 441 supports the heating member 420 fitted into the recess 440A of the belt support member 440. More specifically, the upstream support portion 441 supports an upstream end of the heating member 420 in the movement direction of the fixing belt 411. The upstream end of the heating member 420 in the movement direction of the fixing belt 411 will be referred to as an upstream end portion 420A of the heating member 420, below.

The downstream support portion 445 supports the heating member 420 fitted into the recess 440A of the belt support member 440. More specifically, the downstream support portion 445 supports a downstream end of the heating member 420 in the movement direction of the fixing belt 411. The downstream end of the heating member 420 in the movement direction of the fixing belt 411 will be referred to as a downstream end portion 420B of the heating member 420, below.

Here, in the present exemplary embodiment, the belt support member 440 receives pressing force from the pressing roller 46 with the heating member 420 interposed therebetween. More specifically, the upstream support portion 441 of the belt support member 440 receives pressing force F1 from the upstream end portion 420A of the heating member 420. The downstream support portion 445 of the belt support member 440 receives pressing force F2 from the downstream end portion 420B of the heating member 420. The pressing force F1 and the pressing force F2 are exerted in a direction D in which the heating member 420 receives pressing force from the pressing roller 46.

In the present exemplary embodiment, as described above, the support frame 430 supports the belt support member 440, and the support frame 430 receives pressing force of the pressing roller 46 via the belt support member 440 and the heating member 420. In this case, the belt support member 440 receives reaction force from the support frame 430. More specifically, the upstream support portion 441 of the belt support member 440 receives reaction force F3 from the upstream frame 431. The downstream support portion 445 of the belt support member 440 receives reaction force F4 from the downstream frame 432.

Figure 5:
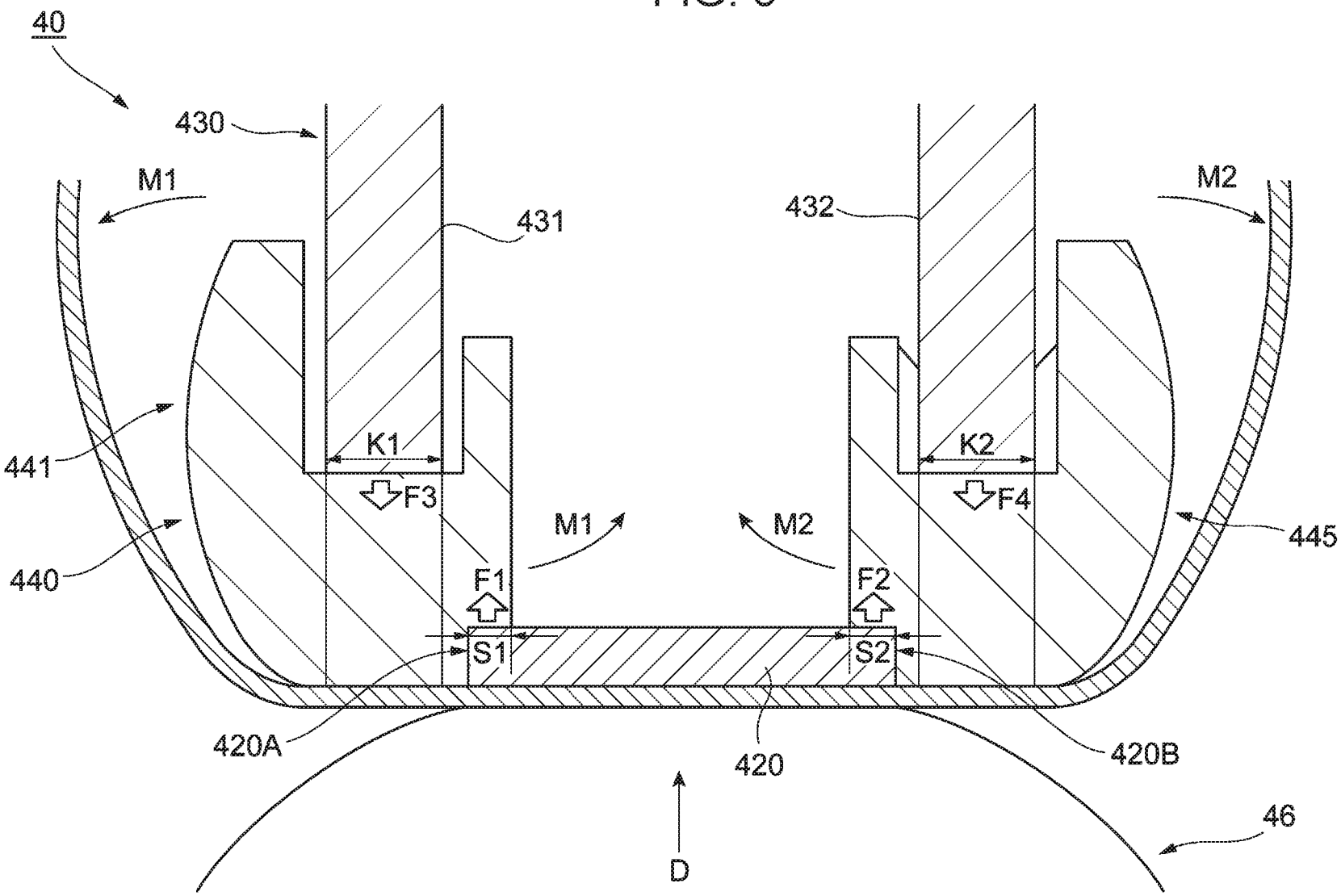
FIG. 5 illustrates a comparative example.

FIG. 5 illustrates a comparative example.

In this comparative example, the area over which the belt support member 440 supports the heating member 420 does not overlap the area over which the belt support member 440 is supported by the support frame 430. More specifically, an area S1 over which the upstream support portion 441 of the belt support member 440 supports the upstream end portion 420A of the heating member 420 and an area K1 over which the upstream support portion 441 is supported by the upstream frame 431 do not overlap in the direction D in which the pressing force of the pressing roller 46 is exerted. An area S2 over which the downstream support portion 445 of the belt support member 440 supports the downstream end portion 420B of the heating member 420 and an area K2 over which the downstream support portion 445 is supported by the downstream frame 432 do not overlap in the direction D in which the pressing force of the pressing roller 46 is exerted.

Here, the upstream support portion 441 receives the pressing force F1 from the upstream end portion 420A of the heating member 420 and the reaction force F3 from the upstream frame 431, and a moment of rotation is exerted on the upstream support portion 441. More specifically, a moment of rotation M1 is exerted on the upstream support portion 441 using a portion of the upstream support portion 441 supported by the upstream frame 431 as a rotation center. The downstream support portion 445 receives the pressing force F2 from the downstream end portion 420B of the heating member 420 and the reaction force F4 from the downstream frame 432, and a moment of rotation is exerted on the downstream support portion 445. More specifically, a moment of rotation M2 is exerted on the downstream support portion 445 using a portion of the downstream support portion 445 supported by the downstream frame 432 as a rotation center. When the moment of rotation M1 exerted on the upstream support portion 441 and the moment of rotation M2 exerted on the downstream support portion 445 are large, the portion of the belt support member 440 connecting the upstream support portion 441 and the downstream support portion 445 may be deformed.

Here, in the present exemplary embodiment, as illustrated in FIG. 4, as in the case of the above comparative example, the upstream support portion 441 receives the pressing force F1 from the heating member 420, and receives the reaction force F3 from the upstream frame 431, and a moment of rotation is exerted on the upstream support portion 441. The downstream support portion 445 receives the pressing force F2 from the heating member 420, and receives the reaction force F4 from the downstream frame 432, and a moment of rotation is exerted on the downstream support portion 445.

However, in the present exemplary embodiment, the area over which the belt support member 440 supports the heating member 420 and the area over which the belt support member 440 is supported by the support frame 430 overlap each other, and thus the moment of rotation exerted on the belt support member 440 is small.

More specifically, in the present exemplary embodiment, the area S1 over which the upstream support portion 441 supports the upstream end portion 420A of the heating member 420 and the area K1 over which the upstream support portion 441 is supported by the upstream frame 431 overlap in the direction D in which the pressing force of the pressing roller 46 is exerted. In other words, the upstream support portion 441 supports an area L1 of the heating member 420 that overlaps the area K1 in the direction D in which the pressing force of the pressing roller 46 is exerted. The area S2 over which the downstream support portion 445 supports the heating member 420 and the area K2 over which the downstream support portion 445 is supported by the downstream frame 432 overlap in the direction D in which the pressing force of the pressing roller 46 is exerted. In other words, the downstream support portion 445 supports an area L2 of the heating member 420 that overlaps the area K2 in the direction D in which the pressing force of the pressing roller 46 is exerted. The area L1 is referred to as a first overlap area L1, below. The area L2 is referred to as a second overlap area L2, below. The area S1 is an example of a first area. The area S2 is an example of a second area.

Here, the portion of the upstream support portion 441 that receives the pressing force F1 from the upstream end portion 420A of the heating member 420 and the portion of the upstream support portion 441 that receives the reaction force F3 from the upstream frame 431 overlap in the direction D in which the pressing force of the pressing roller 46 is exerted. The moment of rotation exerted on the upstream support portion 441 is reduced by the amount of this overlap.

The portion of the downstream support portion 445 that receives the pressing force F2 from the downstream end portion 420B of the heating member 420 and the portion of the downstream support portion 445 that receives the reaction force F4 from the downstream frame 432 overlap in the direction D in which the pressing force of the pressing roller 46 is exerted. The moment of rotation exerted on the downstream support portion 445 is reduced by the amount of this overlap.

In the present exemplary embodiment, an upstream end of the heating member 420 in the movement direction of the fixing belt 411 is a portion supported by the belt support member 440 to overlap the area over which the belt support member 440 is supported by the support frame 430. In other words, in the present exemplary embodiment, the upstream end portion 420A of the heating member 420 is supported by the upstream support portion 441. The upstream end portion 420A thus supported overlaps the area K1 over which the upstream support portion 441 is supported by the upstream frame 431.

For example, if the heating member 420 extends to an upstream portion 420X beyond the area K1 over which the upstream support portion 441 is supported by the upstream frame 431 in the movement direction of the fixing belt 411, a flat portion 411X of the fixing belt 411 extending along the heating member 420 is also extended. Here, the portion of the fixing belt 411 upstream of the nip portion N in the movement direction of the fixing belt 411 moves closer to the transport path of a sheet P.

On the other hand, as in the present exemplary embodiment, when the upstream end portion 420A of the heating member 420 is not disposed upstream of the area K1, over which the upstream support portion 441 is supported by the upstream frame 431, in the movement direction of the fixing belt 411, the flat portion of the fixing belt 411 is shortened. Here, the portion of the fixing belt 411 upstream of the nip portion N in the movement direction of the fixing belt 411 is spaced further apart from the transport path of the sheet P.

MODIFICATION EXAMPLE 1

A modification example of the fixing device 40 will now be described.

Figure 6:
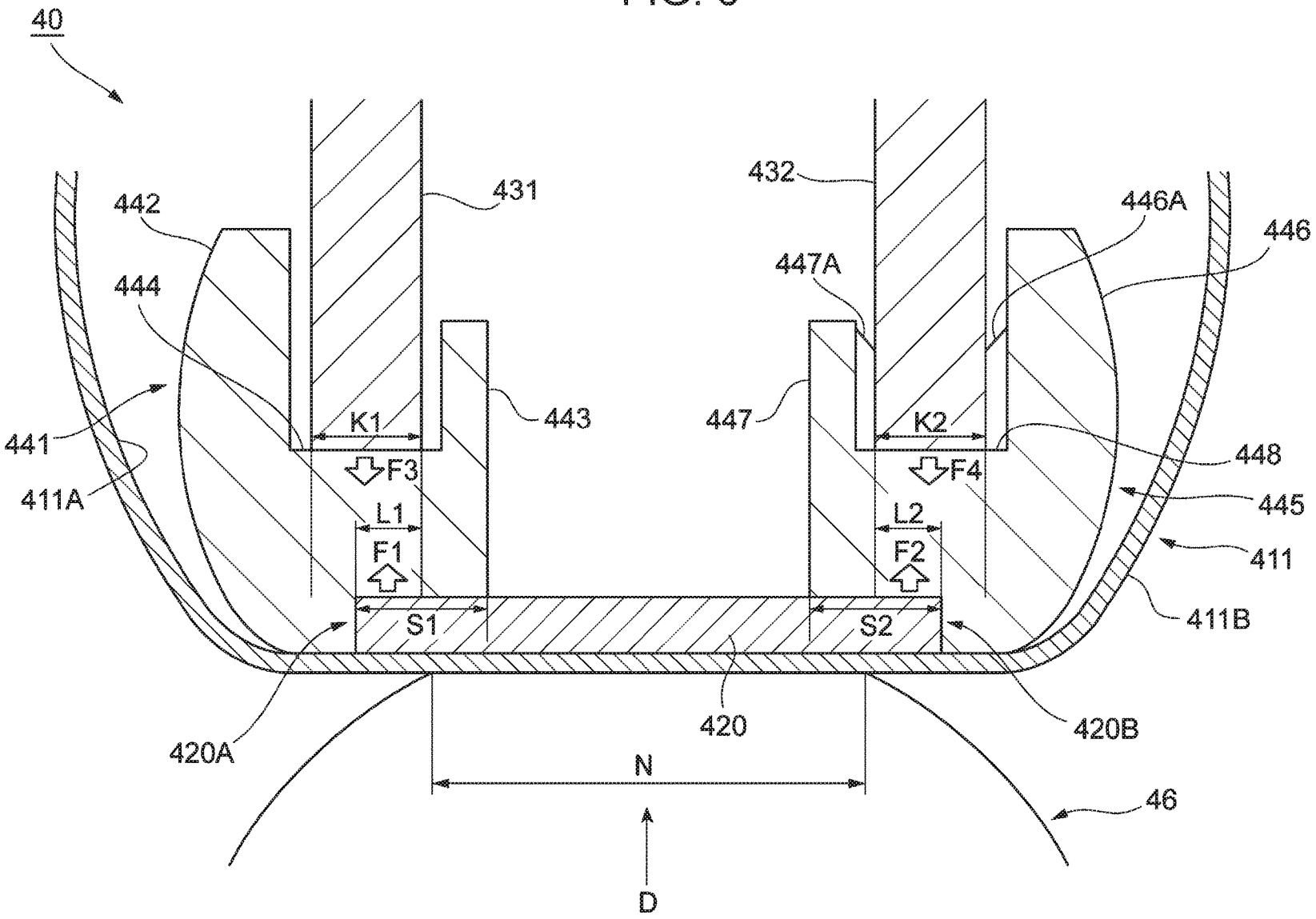
FIG. 6 illustrates a structure of a fixing device according to a modification example.

FIG. 6 illustrates a structure of the fixing device 40 according to a modification example. Components the same as those described above are denoted with the same reference signs.

In the structure illustrated in FIG. 6, the positional relationship between the first overlap area L1, the second overlap area L2, and the nip portion N differs from that illustrated in FIG. 4. More specifically, in the structure illustrated in FIG. 6, the first overlap area L1 and the second overlap area L2 are located outside of the nip portion N in the movement direction of the fixing belt 411. Specifically, the first overlap area L1 and the second overlap area L2 do not overlap the nip portion N in the direction D in which the pressing force of the pressing roller 46 is exerted.

Also in this structure, the moment of rotation exerted on the upstream support portion 441 is reduced by the amount corresponding to the first overlap area L1. In addition, the moment of rotation exerted on the downstream support portion 445 is reduced by the amount corresponding to the second overlap area L2.

In the structure illustrated in FIG. 4, the first overlap area L1 and the second overlap area L2 overlap the nip portion N in the direction D in which the pressing force of the pressing roller 46 is exerted.

In this case, compared to the case where the first overlap area L1 and the second overlap area L2 are disposed outside of the nip portion N in the movement direction of the fixing belt 411, the pressing force exerted on the heating member 420 from the pressing roller 46 is more likely to be dispersed to the upstream end portion 420A and the downstream end portion 420B. Specifically, pressing force exerted on the heating member 420 from the pressing roller 46 is more likely to be dispersed to the first overlap area L1 and the second overlap area L2 of the heating member 420.

MODIFICATION EXAMPLE 2

A modification example (modification example 2) of the fixing device 40 will now be described.

Figure 7:
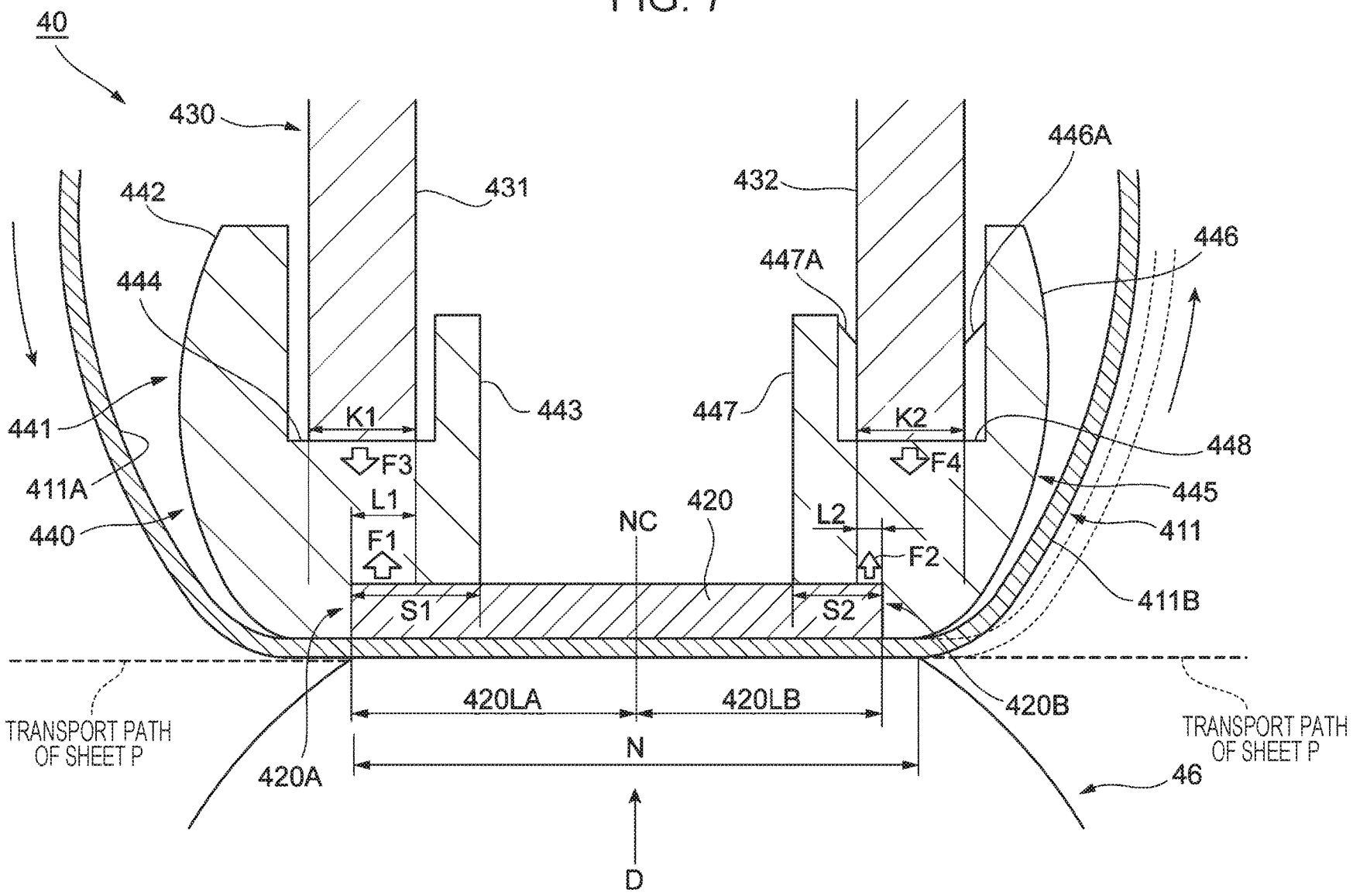
FIG. 7 illustrates a structure of a fixing device according to a modification example.

FIG. 7 illustrates a structure of the fixing device 40 according to a modification example. Components the same as those of the above components are denoted with the same reference signs.

In this modification example, the length of the portion of the heating member 420 upstream of a center NC of the nip portion N in the movement direction of the fixing belt 411 is denoted with a length 420LA. The length of the portion of the heating member 420 downstream of the center NC of the nip portion N in the movement direction of the fixing belt 411 is denoted with a length 420LB. The length 420LB is shorter than the length 420LA.

Here, the flat portion of the fixing belt 411 extending along the heating member 420 is shortened by the amount by which the length 420LB is shortened compared to the structure illustrated in FIG. 4 (refer to the portion with a dotted in the drawing). The portion of the fixing belt 411 downstream of the nip portion N in the movement direction of the fixing belt 411 is thus spaced apart from the transport path of the sheet P.

MODIFICATION EXAMPLE 3

A modification example (modification example 3) of the fixing device 40 will now be described.

Figure 8:
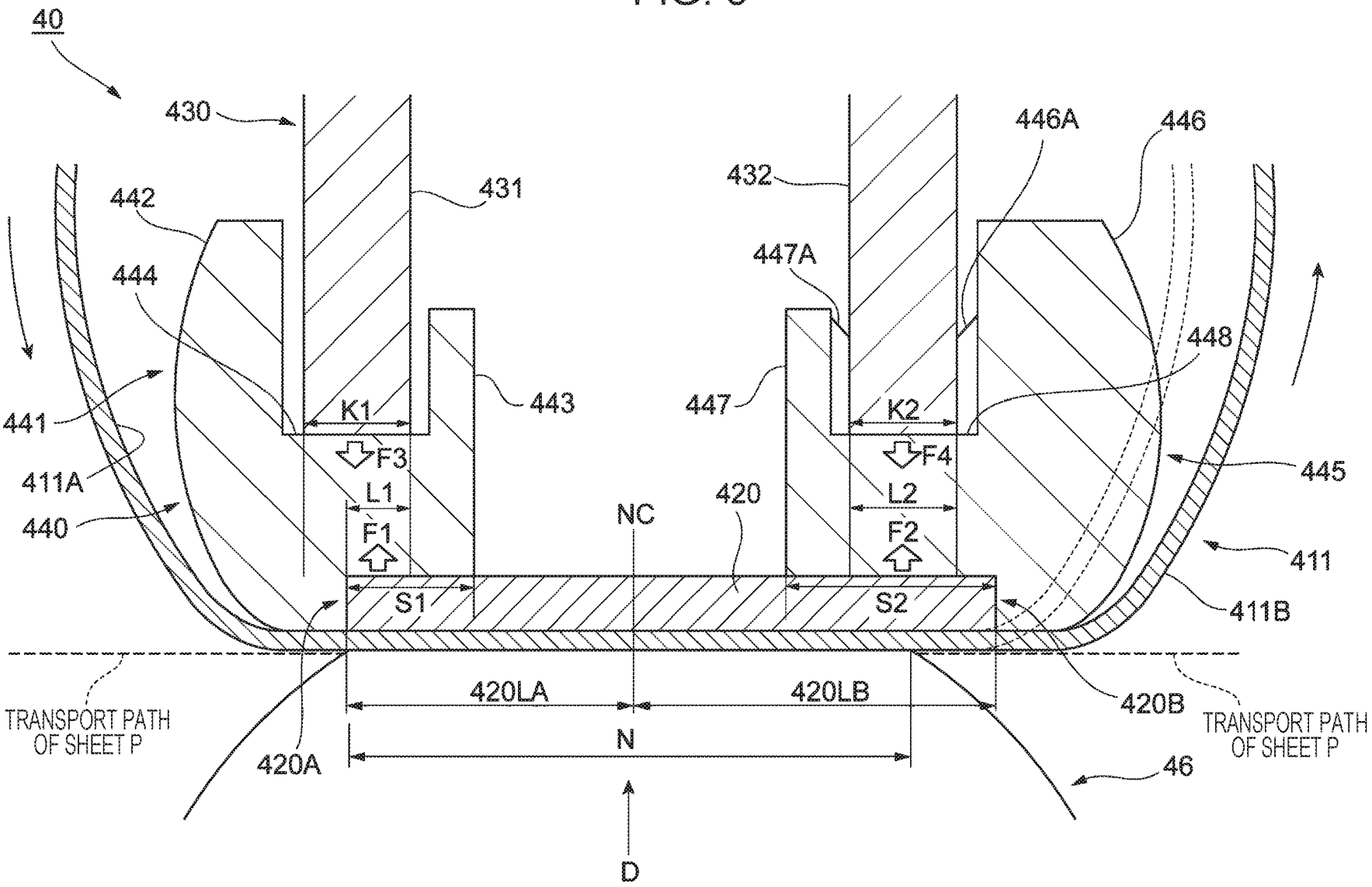
FIG. 8 illustrates a structure of a fixing device according to a modification example.

FIG. 8 illustrates the structure of the fixing device 40 according to the modification example. Components the same as those of the above components are denoted with the same reference signs.

In this modification example, the length of the portion of the heating member 420 upstream of the center NC of the nip portion N in the movement direction of the fixing belt 411 is referred to as a length 420LA. The length of the portion of the heating member 420 downstream of the center NC of the nip portion N in the movement direction of the fixing belt 411 is referred to as a length 420LB. The length 420LB is longer than the length 420LA.

Here, the flat portion of the fixing belt 411 extending along the heating member 420 is extended by the amount corresponding to the increased length 420LB, compared to the structure illustrated in FIG. 4 (refer to the portion with a dotted line in the drawing). In other words, the area over which the sheet P is cooled while the sheet P is transported along the fixing belt 411 after the image is fixed to the sheet P is extended.

MODIFICATION EXAMPLE 4

A modification example (modification example 4) of the fixing device 40 will now be described.

Figure 9:
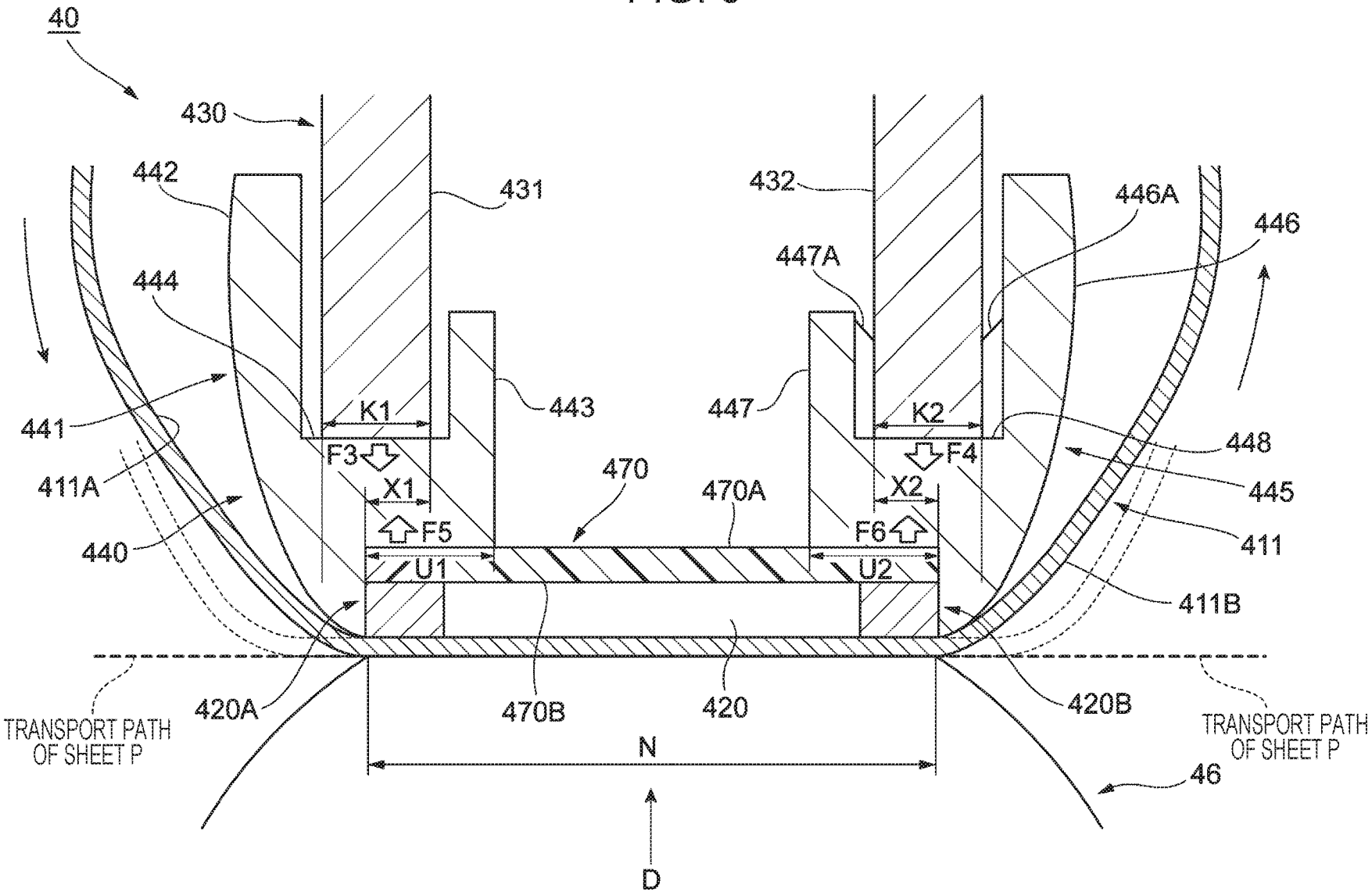
FIG. 9 illustrates a structure of a fixing device according to a modification example.

FIG. 9 illustrates the structure of a fixing device 40 according to a modification example. Components the same as those of the above components are denoted with the same reference signs.

In the structure illustrated in FIG. 9, the fixing belt module 41 includes a support plate 470, which supports the heating member 420.

The support plate 470, which is an example of a first member, has a plate shape, and extends in the movement direction and the axial direction of the fixing belt 411. The support plate 470 is formed from, for example, a resin material. Instead, the support plate 470 may be formed from, for example, a metal material. The support plate 470 has a first surface 470A supported by the upstream support portion 441 and the downstream support portion 445 of the belt support member 440. The support plate 470 has a second surface 470B, opposite to the first surface 470A and supporting the heating member 420.

The heating member 420 is interposed between the support plate 470 and the fixing belt 411 without being directly supported by the belt support member 440.

Here, in the structure illustrated in FIG. 9, the belt support member 440 receives pressing force from the pressing roller 46 via the support plate 470 and the heating member 420. More specifically, the upstream support portion 441 of the belt support member 440 receives pressing force F5 from the support plate 470. The downstream support portion 445 of the belt support member 440 receives pressing force F6 from the support plate 470. As described above, the upstream support portion 441 receives the reaction force F3 from the upstream frame 431, and the downstream support portion 445 receives the reaction force F4 from the downstream frame 432.

In the structure illustrated in FIG. 9, the area over which the belt support member 440 supports the support plate 470 and the area over which the belt support member 440 is supported by the support frame 430 overlap each other. More specifically, an area U1 over which the upstream support portion 441 of the belt support member 440 supports the support plate 470 and the area K1 over which the upstream support portion 441 is supported by the upstream frame 431 overlap each other in the direction D in which the pressing force of the pressing roller 46 is exerted. In other words, the upstream support portion 441 supports an area X1 of the support plate 470 that overlap the area K1 in the direction D in which the pressing force of the pressing roller 46 is exerted. An area U2 over which the downstream support portion 445 of the belt support member 440 supports the support plate 470 and the area K2 over which the downstream support portion 445 is supported by the downstream frame 432 overlap each other in the direction D in which the pressing force of the pressing roller 46 is exerted. In other words, the downstream support portion 445 supports the area X2 of the support plate 470 that overlaps the area K2 in the direction D in which the pressing force of the pressing roller 46 is exerted. The area X1 is regarded as a first overlap area. The area X2 is regarded as a second overlap area. The area U1 is an example of a first area. The area U2 is an example of a second area.

Here, the portion where the upstream support portion 441 receives the pressing force F5 from the support plate 470 and the portion where the upstream support portion 441 receives the reaction force F3 from the upstream frame 431 overlap in the direction D in which the pressing force of the pressing roller 46 is exerted. The moment of rotation exerted on the upstream support portion 441 is reduced by the amount corresponding to this overlap.

The portion where the downstream support portion 445 receives the pressing force F6 from the support plate 470 and the portion where the downstream support portion 445 receives the reaction force F4 from the downstream frame 432 overlap in the direction D in which the pressing force of the pressing roller 46 is exerted. The moment of rotation exerted on the downstream support portion 445 is reduced by the amount corresponding to this overlap.

In the structure illustrated in FIG. 9, the heating member 420 is disposed on the inner side of the area X1 and the area X2 in the movement direction of the fixing belt 411. Specifically, the heating member 420 is shorter than that in the structure illustrated in FIG. 4.

Here, the flat portion of the fixing belt 411 extending along the heating member 420 is shortened by the reduced amount of the heating member 420 further than that in the structure illustrated in FIG. 4 (refer to the portion with dotted line in the drawing). Thus, the portion of the fixing belt 411 outside of the nip portion N in the movement direction of the fixing belt 411 is spaced further apart from the transport path of the sheet P.

In the structure illustrated in FIG. 9, the area X1 and the area X2 overlap the nip portion N in the direction D in which the pressing force of the pressing roller 46 is exerted. However, the area X1 and the area X2 may be disposed on the outer side of the nip portion N in the movement direction of the fixing belt 411. Specifically, the area X1 and the area X2 may not overlap the nip portion N in the direction D in which the pressing force of the pressing roller 46 is exerted.

In the structure illustrated in FIG. 9, the length of the portion of the support plate 470 downstream of the center of the nip portion N in the movement direction of the fixing belt 411 may be longer or shorter than the length of the portion of the support plate 470 upstream of the center of the nip portion N.

The present disclosure has been described using an electrophotographic image forming apparatus, but not limited to the electrophotographic image forming apparatus. The present disclosure is also applicable to, for example, an inkjet image forming apparatus that comes into contact with a sheet carrying an undried image formed from ink (unfixed ink image) to fix the unfixed ink image onto the sheet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device, comprising:

a belt member;

a pressing member that forms a passer between the pressing member and the belt member, the passer passing while pressing a recording medium;

a first member that comes into contact with the belt member on an inner side of the belt member, the first member receiving pressing force in a first direction from the pressing member;

a second member that is disposed on the inner side of the belt member, the second member receiving pressing force of the pressing member with the first member interposed therebetween; and a support member interposed between the first member and the second member, the support member supporting the first member so that an area over which the support member supports the first member and an area over which the support member is supported by the second member overlap in the first direction, wherein two opposite ends of the first member in a movement direction of the belt member are in contact with the support member.

2. The fixing device according to claim 1, wherein the support member extends from an upstream side of a center of the passer to a downstream side of the center of the passer in the movement direction of the belt member, and the support member includes an upstream support portion, which supports the first member on the upstream side, and a downstream support portion, which supports the first member on the downstream side, wherein the second member supports a first area of the upstream support portion and a second area of the downstream support portion, wherein the upstream support portion supports a first overlap area of the first member that overlaps the first area in the first direction; and wherein the downstream support portion supports a second overlap area of the first member that overlaps the second area in the first direction.

3. The fixing device according to claim 2, wherein the first overlap area and the second overlap area overlap the passer in the first direction.

4. The fixing device according to claim 2, further comprising:

a heating member interposed between the belt member and the first member, and disposed on an inner side of the first overlap area and the second overlap area in the movement direction, the heating member heating the belt member while being in contact with the belt member.

5. The fixing device according to claim 1, wherein the first member is a heating member, extends in the movement direction of the belt member, and has an upstream end in the movement direction supported by the support member so that the upstream end overlaps the area over which the support member is supported by the second member.

6. The fixing device according to claim 5, wherein the heating member extends from an upstream side of a center of the passer to a downstream side of the center of the passer in the movement direction, and a length of a portion of the heating member on the downstream side of the center in the movement direction is smaller than a length of a portion of the heating member on the upstream side of the center in the movement direction.

7. The fixing device according to claim 5, wherein the heating member extends from an upstream side of a center of the passer to a downstream side of the center of the passer in the movement direction, and a length of a portion of the heating member on the downstream side of the center in the movement direction is larger than a length of a portion of the heating member on the upstream side of the center in the movement direction.

8. An image forming apparatus, comprising:

an image forming device that forms an image on a recording medium; and a fixing device that fixes the image formed on the recording medium by the image forming device onto the recording medium, wherein the fixing device is formed from the fixing device according to claim 1.

9. A fixing device, comprising:

belt means;

pressing means for forming a passer between the pressing means and the belt means, the passer passing while pressing a recording medium;

first means for receiving pressing force in a first direction from the pressing means, the first means coming into contact with the belt means on an inner side of the belt means;

second means for receiving pressing force of the pressing means with the first means interposed therebetween, the second means being disposed on the inner side of the belt means; and support means for supporting the first means so that an area over which the support means supports the first means and an area over which the support means is supported by the second means overlap in the first direction, the support means interposed between the first means and the second means, wherein two opposite ends of the first means in a movement direction of the belt means are in contact with the support means.

* * * * *